US009395151B2

(12) United States Patent
Somogy et al.

(10) Patent No.: US 9,395,151 B2
(45) Date of Patent: Jul. 19, 2016

(54) FORE-END GRIP FOR A FIREARM

(71) Applicants: Derek James Somogy, Peoria Heights, IL (US); Jason Douglas Sopko, West Chester, OH (US)

(72) Inventors: Derek James Somogy, Peoria Heights, IL (US); Jason Douglas Sopko, West Chester, OH (US)

( * ) Notice: Subject to any disclaimer, the term of this patent is extended or adjusted under 35 U.S.C. 154(b) by 0 days.

(21) Appl. No.: 14/505,888

(22) Filed: Oct. 3, 2014

(65) Prior Publication Data

US 2015/0096215 A1 Apr. 9, 2015

Related U.S. Application Data

(60) Provisional application No. 61/886,614, filed on Oct. 3, 2013.

(51) Int. Cl.
*F41C 23/16* (2006.01)

(52) U.S. Cl.
CPC ..... *F41C 23/16* (2013.01)

(58) Field of Classification Search
CPC ..... F41C 23/16
USPC ..... 42/71.01–74, 83, 85, 90, 96, 106
See application file for complete search history.

(56) References Cited

U.S. PATENT DOCUMENTS

| | | | | |
|---|---|---|---|---|
| 1,277,002 | A | 8/1918 | Van Name | |
| 1,503,251 | A * | 7/1924 | Schoof | A01C 5/02 111/99 |
| 5,010,676 | A * | 4/1991 | Kennedy | F41C 23/16 42/71.01 |
| 5,857,279 | A * | 1/1999 | de Oliveira Masina | F41C 23/10 42/71.01 |
| D439,628 | S | 3/2001 | Tugwell | |
| D439,948 | S * | 4/2001 | Fletcher | F41C 23/16 D22/100 |
| D656,215 | S | 3/2012 | Fitzpatrick et al. | |
| D665,043 | S | 8/2012 | Fitzpatrick et al. | |
| 8,438,769 | B1 | 5/2013 | Ghannam | |
| 8,528,246 | B2 | 9/2013 | Telles | |
| 9,228,804 | B2 * | 1/2016 | Syrengelas | F41C 7/02 |
| 2011/0107642 | A1 | 5/2011 | Godard | |
| 2011/0107643 | A1 | 5/2011 | Fitzpatrick et al. | |
| 2012/0005930 | A1 * | 1/2012 | Cragg | F41A 11/02 42/1.06 |
| 2014/0196342 | A1 * | 7/2014 | Syrengelas | F41C 7/02 42/71.01 |
| 2015/0082679 | A1 | 3/2015 | Michal et al. | |

* cited by examiner

*Primary Examiner* — Stephen M Johnson
*Assistant Examiner* — Benjamin Gomberg

(57) ABSTRACT

A fore-end grip is provided for a firearm. The firearm has a barrel, and the fore-end grip is configured to at least partially surround the barrel. The fore-end grip includes at least one finger channel and at least one thumb channel. The finger channel and the thumb channel are configured to receive at least one finger and the thumb, respectively, of a shooter's forward hand when the shooter holds the firearm.

20 Claims, 5 Drawing Sheets

FORE-END GRIP FOR A FIREARM

TECHNICAL FIELD

The present invention relates to firearms, and more particularly, to grip devices for firearms.

BACKGROUND

While firearm technology has progressively developed over the years, the art has recently experienced focused advances in ergonomics and component modularity. Competitive sportsmen, tactical shooters, and recreational shooters demand innovation in these areas.

One feature that has found wide acceptance is the MIL-STD-1913 rail system (which is sometimes also referred to as a picatinny rail, or simply a rail). The MIL-STD-1913 picatinny rail is a dovetailed mounting interface having a plurality of periodically spaced ridges and slots. As is the case with all equipment defined by a Military Standard (MIL-STD) specification, the dimensions of the picatinny rail are standardized. As a result, picatinny rails and accessories configured to conform to the 1913 standard may be readily interchanged. Of importance to many shooters, since the picatinny rails utilize a repeating pattern of ridges and slots, accessories may be mounted and dismounted many times while maintaining the same orientation in space with respect to the firearm. For rifles scopes, laser designators, and this like, this allows aiming accuracy to be maintained after repeated cycles of mounting and dismounting.

The picatinny rail may be affixed to, or may form an integral structure of, a rifle receiver, rifle fore-end stock, pistol frame, or the like. Once a firearm is configured with a picatinny rail interface, accessories may be rapidly mounted by or removed by the shooter.

One common configuration of the picatinny rail system is the quad rail. Often found on AR-15 type carbines or rifles, the quad rail is a collection of four picatinny rails, mounted at the fore end of the rifle. Each of the four picatinny rails is disposed radially with respect to the rifle barrel at 12 o'clock, 3 o'clock, 6 o'clock, and 9 o'clock positions. The rail at the 12 o'clock position is often at the same height over the barrel as a rail mounted at the top of the receiver. This configuration allows accessories to span, or simultaneously mount to, the receiver and the rail at the 12 o'clock position. Likewise, the remaining three sets of rails allow additional accessories to be mounted without obscuring the line of sight above the 12 o'clock rail (often occupied with a telescopic scope or other optic).

While the quad rail provides outstanding versatility with respect to receiving accessories, it was not designed from an ergonomic standpoint. Since the quad rail is often the primary contact point for a shooter's forward hand, this is a significant shortcoming. The somewhat sharp and angular edges of the picatinny rail's ridges dig into a shooter's hand upon grasping. Moreover, the pattern of protruding ridges of the picatinny rail may snag on gear and environmental objects.

Several manufacturers produce rail covers that mask the picatinny rail sections not occupied by accessories. These rail covers do not provide notable ergonomic benefits, however.

Some rail accessories provide some ergonomic benefits to discrete portions of the quad rail by adding projections therefrom. For example, the vertical fore grip (VFG) is often a projection that extends from the 6 o'clock picatinny rail at approximately ninety degrees therefrom. A shooter my either grasp the VFG with his entire hand (broom handle configuration), or may grasp the quad rail with the bulk of his hand while using the FVG to prevent undesired rearward slipping of his hand (hand-stop configuration). While the VFG does serve as a hand-stop, its projection from the quad rail interferes with several important shooting postures. For example, supporting the quad rail with a sand bag becomes extremely cumbersome, if not impossible. Also, while shooting prone, the firearm tends to rock on the contact point between the VFG and the ground (thus impairing accuracy). Further, the VFG may prevent a shooter from using objects in his environment for support, or may snag on equipment or objects used for cover or concealment.

Several products provide a ledge or ramp feature on the 6 o'clock picatinny rail to serve as a hand-stop without the substantial projection distance of the VFG. Such products only serve as a hand stop along a single rail, however, and do not reduce fatigue by providing additional support to the shooter's hand at other points around the quad rail. Moreover, prior art devices to not serve as a training aid for proper positioning of the shooter's forward hand on the firearm.

As a result, there exists a need in the art for improvements relating to how a shooter's forward hand holds a firearm.

SUMMARY OF THE INVENTION

The present invention relates to a fore-end grip for a firearm, and a firearm having such a fore-end grip. The fore-end grip is located between the receiver and the muzzle of the firearm. The fore-end grip includes a finger channel and a thumb channel, such that the finger channel receives a finger and the thumb channel receives the thumb of the shooter's hand. The fore-end grip may include two thumb channels, whereby each thumb channel provides an alternative location for a shooter's thumb. Also, the fore-end grip may include four finger channels, one for each of the four fingers of the shooter's hand. Advantageously, the fore-end grip allows a shooter to firmly hold the firearm, and to consistently hold the firearm in the same manner, with his thumb and fingers in the same location.

According to one aspect of the invention, a fore-end grip is provided for a firearm. The firearm has a barrel, and the fore-end grip is configured to at least partially surround the barrel. The fore-end grip includes at least one finger channel and at least one thumb channel. The at least one finger channel and the at least one thumb channel are configured to receive at least one finger and the thumb, respectively, of a shooter's forward hand when the shooter holds the firearm.

According to another aspect of the invention, a firearm is provided and includes a receiver and a barrel extending from the receiver and including a muzzle. The firearm further includes a rear grip and a fore-end grip. The rear grip is configured to be held by a shooter's rearward hand when the shooter holds the firearm. The fore-end grip at least partially surrounds the barrel and is configured to be held by the shooter's forward hand with the shooter's palm facing the barrel when the shooter holds the firearm. The fore-end grip is located between the receiver and the muzzle, and includes at least one finger channel and at least one thumb channel. The at least one finger channel and the at least one thumb channel are configured to receive at least one finger and the thumb, respectively, of the shooter's forward hand.

BRIEF DESCRIPTION OF THE DRAWINGS

The accompanying drawings, which are incorporated in and constitute a part of this specification, illustrate embodiments of the invention and, together with the general description given above and the detailed description of the embodiments given below, serve to explain the principles of the invention. In the figures, corresponding or like numbers or characters indicate corresponding or like structures.

DETAILED DESCRIPTION

The following description and the accompanying figures present a particular fore-end grip (having four finger channels and two thumb channels) in the context of a particular style of firearm (a modern semi-automatic carbine). It will be appreciated, however, that the fore-end grip can have different characteristics than the specific configuration shown in the figures, and that the fore-end grip can be used with a wide range of firearms. For example, fore-end grip may be used with longer-barreled rifles, firearms having different types of actions, shotguns, and certain types of pistols.

Figure 1:
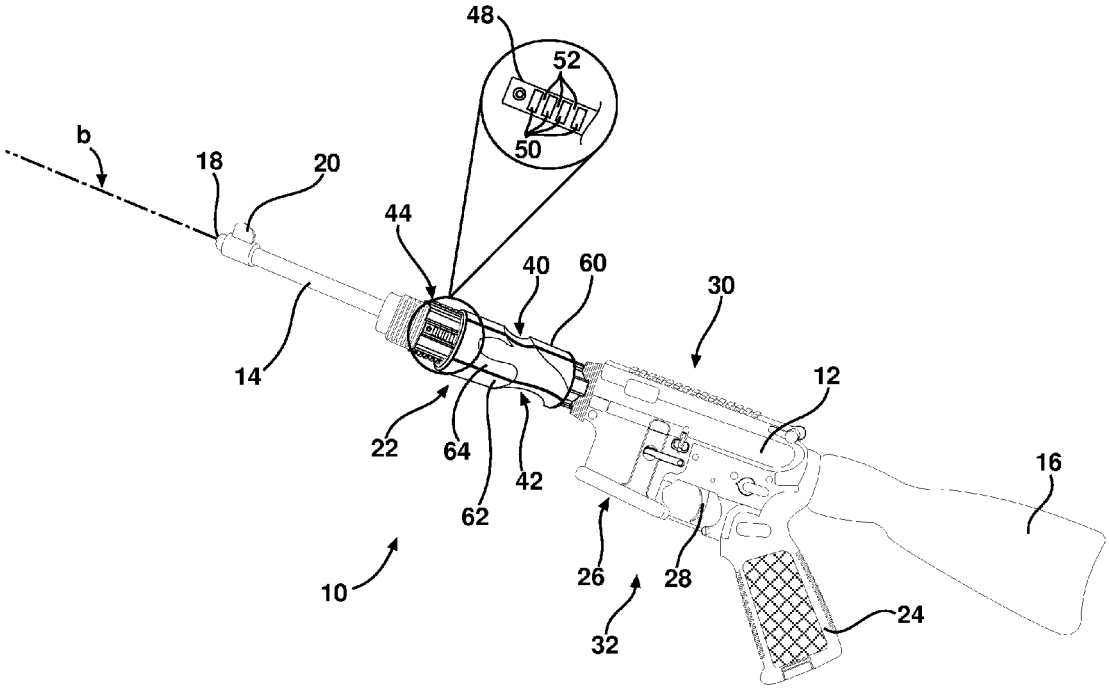
FIG. 1 is a side view of a firearm including a fore-end grip according to the concepts of the present invention.

Referring to the figures and beginning with FIG. 1, a firearm 10 generally includes a receiver 12, a barrel 14, and a stock 16. The barrel 14 is coupled with, and extends forwardly from, the receiver 12. The barrel 14 includes a muzzle 18, which is the opening at the end of the barrel 14 where a projectile exits the barrel 14. The barrel 14 extends along a barrel axis "b." A front sight post 20 extends upwardly from the barrel 14 proximate the muzzle 18. The stock 16 extends rearwardly from the receiver 12.

The firearm 10 also includes a fore-end grip 22 and a rear grip 24. A shooter holds the fore-end grip 22 and the rear grip 24 when shooting the firearm 10, as will be described further below. The fore-end grip 22 is located between the receiver 12 and the muzzle 18. The rear grip 24 is coupled with the receiver 12 generally proximate the stock 16.

The firearm 10 also includes a magazine well 26 that is configured to receive a magazine holding one or more cartridges (magazine and cartridges not shown). The firearm 10 also includes a trigger 28 and a bolt assembly (not shown).

In its normal operating orientation, the firearm 10 generally includes a top side 30, a bottom side 32, a left side 34, and a right side 36.

When a shooter holds the firearm 10 to shoot it, he holds the fore-end grip 22 with his forward hand and the rear grip 24 with his rearward hand. In addition, the shooter typically raises the stock 16 and presses it into his shoulder. With his forward hand, the shooter holds the fore-end grip 22 and adjusts the aim of the firearm 10 so that the front sight post 20 generally aligns with a distant target. The shooter pulls the trigger 28 using a finger of his rearward hand, and the firearm 10 operates to propel a projectile down the barrel 14 and out of the muzzle 18 toward the distant target.

Figure 2:
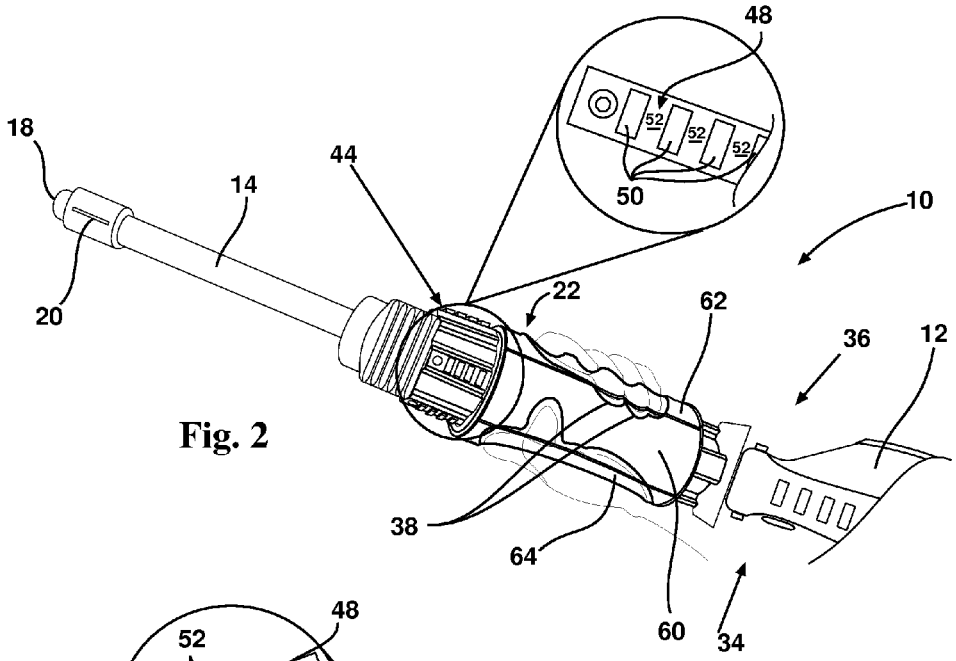
FIG. 2 is a top view showing a portion of a top side of the firearm of FIG. 1, and showing a shooter's hand holding the fore-end grip.
Figure 3:
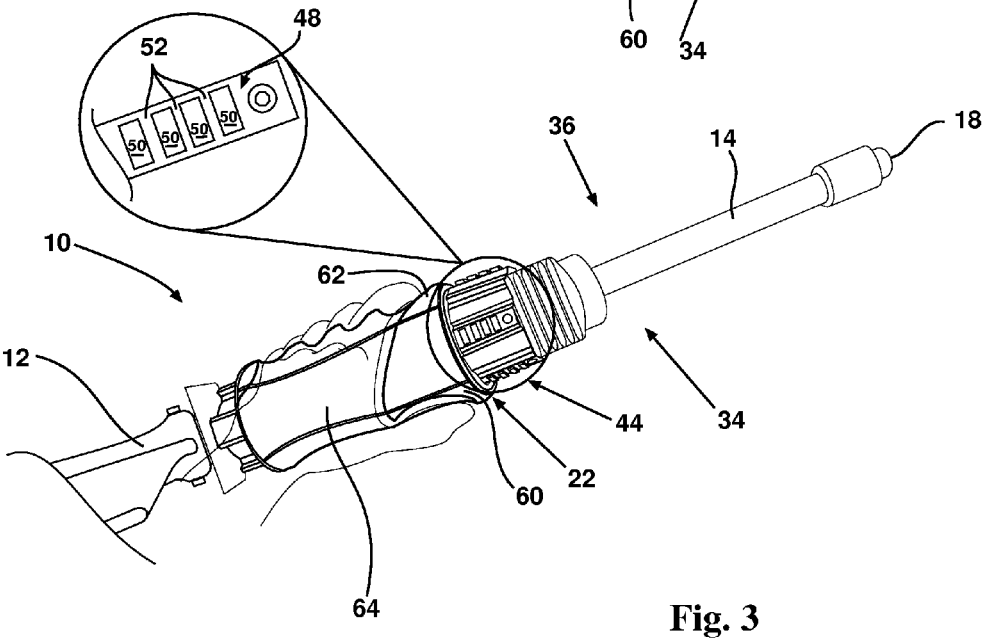
FIG. 3 is a bottom view showing a portion of a bottom side of the firearm of FIG. 1, and showing a shooter's hand holding the fore-end grip.

The fore-end grip 22 at least partially surrounds the barrel 14 and generally includes at least one finger channel 38 (as best illustrated in FIG. 2) and at least one thumb channel 40, which are configured to receive a finger and the thumb of the shooter's forward hand when he holds the firearm 10. Thereby, the shooter holds the firearm 10 with the palm of his forward hand facing the barrel 14, and with his thumb and fingers at least partially surrounding the barrel 14. For example, the shooter's forward hand may take on a c-shaped orientation when he holds the fore-end grip 22, with his thumb extending over the barrel 14, his hand generally wrapping around the side of the fore-end grip 22, and with his fingers extending under the barrel 14.

Figure 4:
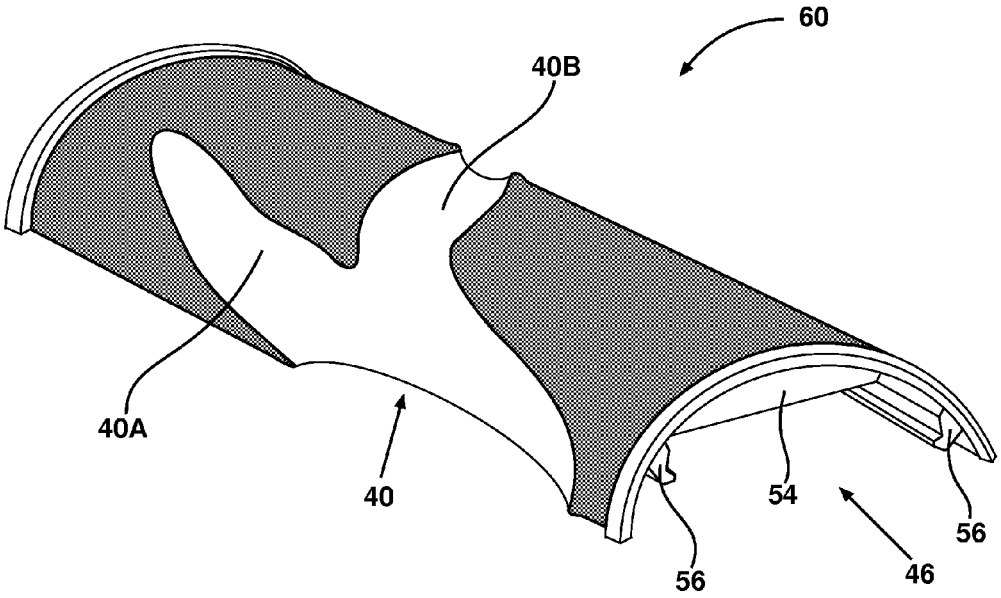
FIG. 4 is an isometric view showing one of a plurality of grip panels that form the fore-end grip of FIG. 1, the grip panel including two thumb channels.
Figure 7:
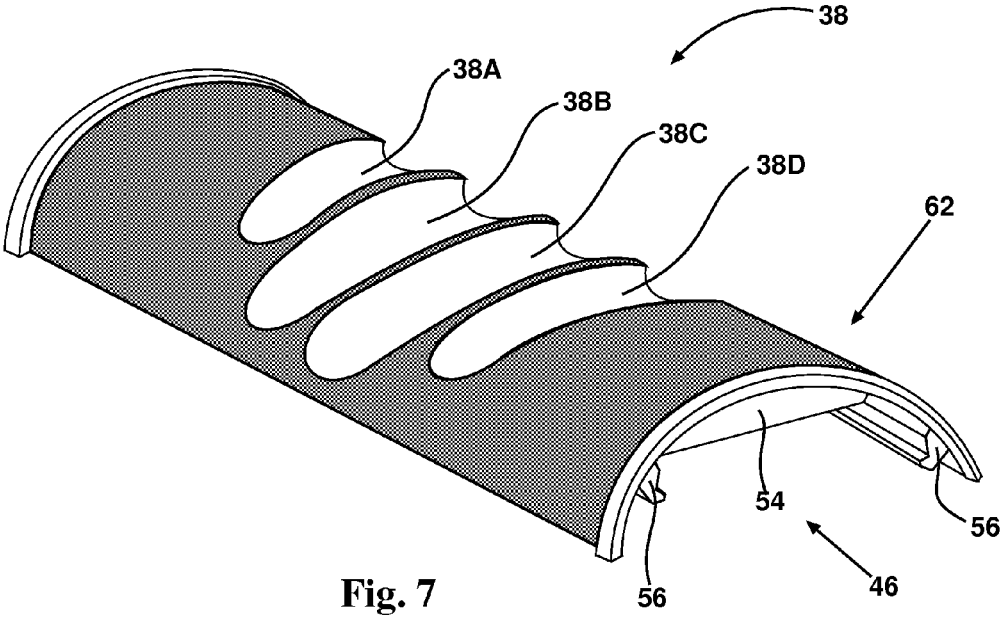
FIG. 7 is an isometric view showing another of the plurality of grip panels that form the fore-end grip of FIG. 1, the grip panel including four finger channels.
Figure 8:
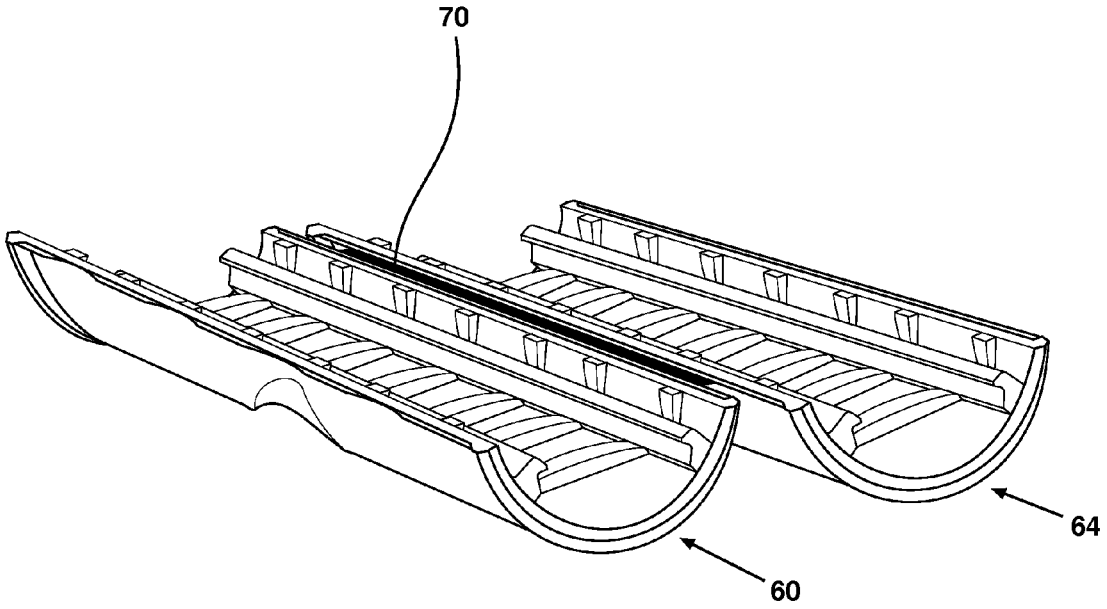
FIG. 8 is an isometric view showing a plurality of grip panels of a fore-end grip, with adjacent grip panels being connected together.

In the particular embodiment shown, the fore-end grip 22 includes four finger channels 38A, 38B, 38C, and 38D, and two thumb channels 40A, 40B. In particular, the finger channels 38A, 38B, 38C, 38D (as seen in FIGS. 4 and 7, respectively) are each generally configured to receive one of the shooter's fingers (the first finger, middle finger, ring finger, and pinkie finger) of the shooter's forward hand when the shooter holds the firearm 10. In other embodiments, a different number of finger channels are included, and in these or other embodiments, the finger channels can be configured to receive one or more of the shooter's fingers. For example, a single finger channel 38 can be configured to receive all four of the shooter's fingers.

The thumb channels 40A, 40B are configured to provide alternative locations for the thumb of the shooter's forward hand when the shooter holds the firearm 10. The shooter may thereby choose to position his thumb in either the thumb channel 40A or the thumb channel 40B, depending on how he prefers to hold the fore-end grip 22. In other embodiments, a different number of thumb channels can be included, such as a single thumb channel 40.

As shown, the thumb channel 40A extends in a direction generally along the barrel axis b. In particular, the thumb channel 40A is positioned, at least partially, along the left side 34 of the firearm 10. Such a configuration may be appropriate for a right-handed shooter, because a right-handed shooter typically holds the fore-end grip 22 with his left hand. Alternatively, the thumb channel 40A could be positioned, at least partially, along the right side 36 of the firearm 10, such as in a configuration for a left-handed shooter who holds the fore-end grip 22 with his right hand. When the shooter holds the firearm 10 with his thumb in the thumb channel 40A, his thumb is positioned along the barrel 14. In other embodiments, the thumb channel 40A may be positioned, at least partially, along the top side 30 of the firearm 10.

The thumb channel 40B, in contrast, extends in a direction across the barrel axis b. In particular, the thumb channel 40B is generally positioned along the top side 30 of the firearm 10. When the shooter holds the firearm 10 with his thumb in the thumb channel 40B, his thumb is positioned above, and generally across, the barrel 14. In other embodiments, the thumb channel 40B may be positioned, at least partially, along the left side 34, the right side 36, or both, of the firearm 10.

The finger channels 38A, 38B, 38C, 38D are positioned, at least partially, on the bottom side 32 of the firearm 10. The finger channels 38A, 38B, 38C, 38D may also be positioned, such as partly positioned, on either the left side 34 or the right side 36, or both, of the firearm 10.

The fore-end grip 22 may also include a palm channel 42 that is positioned between the finger channels 38A, 38B, 38C, 38D and the thumb channels 40A, 40B. The palm channel 42 is configured to receive the palm of the shooter's forward hand when he holds the firearm. The palm channel 42 is positioned, at least partially, on the left side 34 of the firearm 10 (but could also be on the right side 36, depending on the configuration of the fore-end grip).

Depending on a desired orientation of the shooter's forward hand relative to the firearm 10, the finger channels 38A, 38B, 38C, 38D, the thumb channels 40A, 40B, and the palm channel 42 may be positioned, partially or completely, on any of the sides 30, 32, 34, 36 of the firearm 10.

In the embodiment shown, the firearm 10 also includes a fore-end stock 44 that generally surrounds the barrel 14 and is positioned between the receiver 12 and the muzzle 18. The fore-end grip 22 is attached to the fore-end stock 44.

Figure 5:
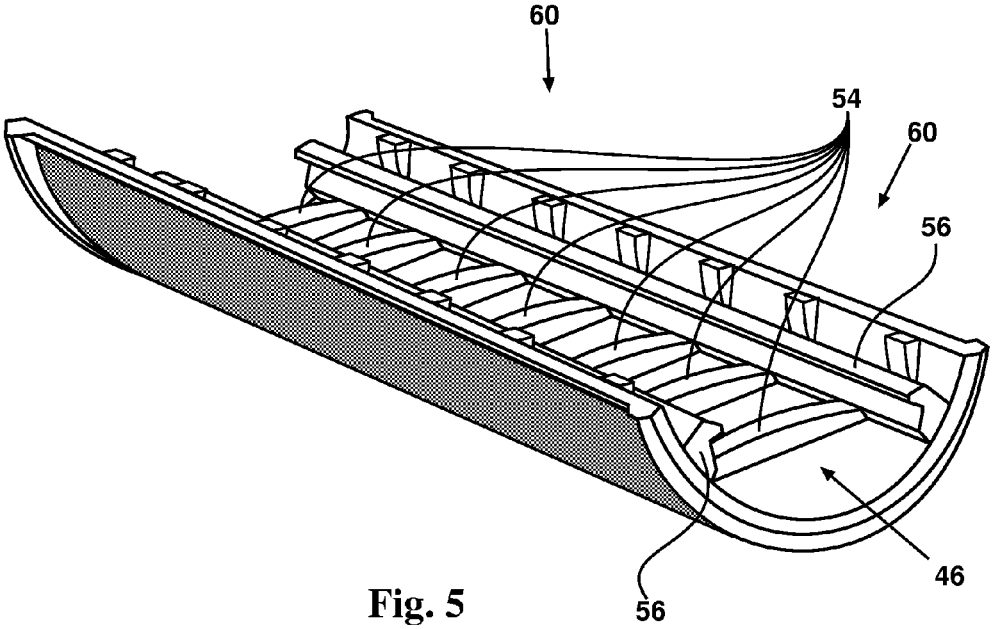
FIG. 5 is an isometric view showing attachment members of the grip panel of FIG. 4, the attachment members being for attaching the grip panel to a fore-end stock of the firearm of FIG. 1.
Figure 6:
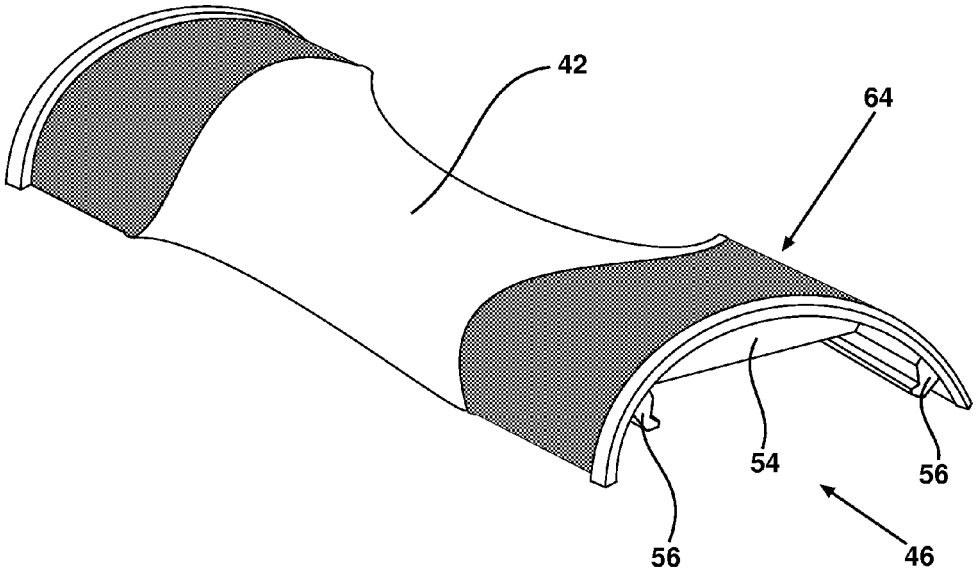
FIG. 6 is an isometric view showing another of the plurality of grip panels that form the fore-end grip of FIG. 1, the grip panel including a palm channel.

The fore-end grip 22 includes one or more attachment members 46 (see FIG. 5) for engaging with the fore-end stock 44 to attach the fore-end grip 22 to the fore-end stock. In particular, the one or more attachment members 46 are positioned along a barrel-facing side of the fore-end grip 22, generally opposite from the finger channels 38A, 38B, 38C, 38D and the thumb channels 40A, 40B.

The fore-end stock 44 includes four picatinny rail segments 48, with a picatinny rail segment 48 on each of the top side 30, the bottom side 32, the left side 34, and the right side 36 of the firearm 10. Thereby, the fore-end stock 44 has a "quad rail" configuration, with a picatinny rail segment at each of the 12 o'clock, 3 o'clock, 6 o'clock, and 9 o'clock positions. The fore-end grip 22 is attached to the picatinny rail segments 48. Each picatinny rail segment 48 includes a row of a plurality of ridges 50 and slots 52. The one or more attachment members 46 engage the ridges 50 and slots 52. In particular, the one or more attachment members 46 include one or more lugs 54 that engage with, or fit within, the slots 52 between the ridges 50. The one or more attachment members 46 can also include one or more jaws 56 that engage one or more of the ridges 50 along a side of the row of ridges 50 and slots 52.

In other embodiments, the fore-end stock 44 may take a different form, and may not include picatinny rail segments 48. In these or other embodiments, the fore-end grip 22 may be integrally formed with the fore-end stock 44. In even other embodiments, the fore-end stock 44 may generally include a plurality of slots or keyhole shaped profiles, and the one or more lugs 54 of the one or more attachment members 46 may engage with at least one of the slots for attaching the fore-end grip 22 to the fore-end stock 44. Examples of fore-end stocks that generally include a plurality of slots include Magpul MOE handguard products sold by Magpul Industries Corp. of Boulder, Colo., and Keymod handguard products sold by Bravo Company USA, Inc. of Hartland, Wis.

In the embodiment shown, the fore-end grip 22 is formed of a plurality of grip panels. In particular, the fore-end grip 22 is formed of a top grip panel 60, a bottom grip panel 62, and a side grip panel 64. The plurality of grip panels may be configured to be separately attached to the fore-end stock 44. In particular, the top grip panel 60 is configured to be attached to the picatinny rail segment 48 on the top side 30, the bottom grip panel 62 is configured to be attached to the picatinny rail segment 48 on the bottom side 32, and the side grip panel 64 is configured to be attached to the picatinny rail segment 48 on the left side 34 (for a right-handed shooter configuration, but could also be attached to the picatinny rail segment 48 on the right side 36 for a left-handed shooter configuration). As shown, the thumb channels 40A, 40B may be included on the top grip panel 60 and the side grip panel 64, the finger channels 38A, 38B, 38C, 38D may be included on the bottom grip panel 62, and the palm channel 42 may be included on the side grip panel 64. Advantageously, such a configuration leaves open one of the picatinny rail segments 48 (on either the right side 36 or the left side 34) for attachment of another accessory to the open picatinny rail segment 48.

In other embodiments, each grip panel may be coupled with an adjacent grip panel, and the plurality of grip panels are configured to be collectively attached to the fore-end stock 44. For example, adjacent grip panels may be connected by structure that functions generally as a hinge 70 to permit relative pivoting between the adjacent grip panels.

In these or other embodiments, the fore-end grip 22 may be comprised of a different number of grip panels, and may partially or completely surround the fore-end stock 44.

In other embodiments, the fore-end grip 22 may be formed of a single, generally unitary structure that is attached to the fore-end stock 44.

The fore-end grip 22 may be constructed of any suitable material. For example, the fore-end grip 22 can include a rubber material (that is somewhat sticky) in the finger channels 38A, 38B, 38C, 38D, and in the thumb channels 40A, 40B. The rubber material may be confined to regions of the finger channels 38A, 38B, 38C, 38D and the thumb channels 40A, 40B. Portions of the fore-end grip 22 that surround the finger channels 38A, 38B, 38C, 38D and the thumb channels 40A, 40B can include a comparatively harder and less sticky material, for example. Also, the finger channels 38A, 38B, 38C, 38D and the thumb channels 40A, 40B may be defined in any appropriate manner, including being outlined by raised ridges, or being recessed below surrounding portions of the fore-end grip 22.

Advantageously, the fore-end grip 22 provides an ergonomic structure for a shooter to firmly hold the firearm 10. The shooter's thumb fits in one of the thumb channels 40A, 40B, and the shooter's fingers fit in the finger channels 38A, 38B, 38C, 38D. Thereby, the shooter is not likely to lose his grasp on the fore-end grip 22. Moreover, accuracy may be improved since the additional support may reduce fatigue that would otherwise occur from prolonged firm grasping of a conventional grip. In addition, the thumb channels 40A, 40B and the finger channels 38A, 38B, 38C, 38D provide locations where the shooter's thumb and fingers will be placed each time he holds the fore-end grip 22. Thereby, the shooter repeatedly holds the firearm 10 in the same manner, which may provide accuracy benefits when the shooter shoots the firearm 10. Moreover, the fore-end grip 22 allows a shooter to intuitively understand the orientation of the firearm 10 when his thumb and fingers are in one of the thumb channels 40A, 40B and the finger channels 38A, 38B, 38C, 38D, such as when the shooter picks up the firearm 10 in low-light situations. Further still, the fore-end grip 22 may be easily attached to and removed from the firearm 10. In addition, the fore-end grip 22 serves as a training aid to help a shooter learn appropriate positioning of his forward hand relative to the firearm 10, including positions for his thumb, fingers, and palm. Even further still, the firearm 10 having the fore-end grip 22 can be easily used with a support, such as a sand bag, and can easily be shot from the prone position.

While the invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. A fore-end grip for a firearm having a barrel that extends along a barrel axis, the fore-end grip being configured to at least partially surround the barrel and comprising:

a top surface configured to be positioned above the barrel, at least one finger channel, and a thumb channel positioned on the top surface and configured to extend along the top surface in a direction across the barrel axis and over the top side of the barrel, the at least one finger channel and the thumb channel being configured to receive at least one finger and the thumb, respectively, of a shooter's forward hand when the shooter holds the firearm.

2. The fore-end grip of claim 1, the thumb channel being a first thumb channel and further comprising:

a second thumb channel, the first thumb channel and the second thumb channel providing alternative locations for the shooter's thumb when the shooter holds the firearm.

3. The fore-end grip of claim 2, the second thumb channel being configured to extend in a direction along the barrel axis.

4. The fore-end grip of claim 2, wherein the first thumb channel and the second thumb channel are configured so the shooter's thumb will be positioned along the barrel or above the barrel when the shooter holds the firearm.

5. The fore-end grip of claim 1, comprising:

four finger channels, each of the four finger channels being configured to receive one of the shooter's fingers of the shooter's forward hand when the shooter holds the firearm.

6. The fore-end grip of claim 1, wherein the firearm includes a top side, a bottom side, a left side, and a right side, and the thumb channel is configured to be positioned at least partially on the top side.

7. The fore-end grip of claim 6, the thumb channel being a first thumb channel and further comprising:

a second thumb channel configured to be positioned at least partially on one of the left side and the right side.

8. The fore-end grip of claim 6, wherein the at least one finger channel is configured to be positioned at least partially on the bottom side.

9. The fore-end grip of claim 1, wherein the firearm includes a fore-end stock, the fore-end grip further comprising:

an attachment member configured to engage with the fore-end stock for attaching the fore-end grip to the fore-end stock.

10. The fore-end grip of claim 9, wherein the fore-end stock includes a rail having a plurality of ridges and slots, and the attachment member includes at least one lug for engaging with at least one of the slots on the rail.

11. The fore-end grip of claim 9, wherein the fore-end stock includes a plurality of slots, and the attachment member includes at least one lug for engaging with at least one of the slots.

12. The fore-end grip of claim 1, further comprising:

a palm channel positioned between the at least one finger channel and the thumb channel, palm channel being configured to receive the palm of the shooter's forward hand when the shooter holds the firearm.

13. The fore-end grip of claim 1, wherein the fore-end grip is comprised of a plurality of grip panels.

14. The fore-end grip of claim 13, wherein the firearm includes a fore-end stock, and the grip panels are configured to be separately attached to the fore-end stock.

15. The fore-end grip of claim 13, wherein the firearm includes a fore-end stock, and each grip panel is coupled with an adjacent grip panel, and the plurality of grip panels are configured to be collectively attached to the fore-end stock.

16. The fore-end grip of claim 1, wherein the at least one finger channel and the thumb channel include a rubber material for contacting at least one finger and the thumb, respectively, of the shooter's forward hand when the shooter holds the firearm.

17. A fore-end grip for a firearm having a barrel that extends along a barrel axis, the fore-end grip being configured to at least partially surround the barrel and comprising:

a top surface configured to be positioned above the barrel, at least one finger channel configured to receive at least one finger of a shooter's forward hand when the shooter holds the firearm, a first thumb channel positioned on the top surface configured to extend along the top surface in a direction across the barrel axis and over the top side of the barrel, and to receive the thumb of the shooter's forward hand when the shooter holds the firearm, and a second thumb channel configured to extend in a direction along the barrel axis and to receive the thumb of the shooter's forward hand when the shooter holds the firearm, the first thumb channel and the second thumb channel providing alternative locations for the shooter's thumb when the shooter holds the firearm.

18. A firearm, comprising:

a receiver, a barrel extending from the receiver and including a muzzle, a rear grip configured to be held by a shooter's rearward hand when the shooter holds the firearm, and a fore-end grip at least partially surrounding the barrel and configured to be held by the shooter's forward hand with the shooter's palm facing the barrel when the shooter holds the firearm, the fore-end grip being located between the receiver and the muzzle, and including:

a top surface positioned above the barrel, at least one finger channel, and a thumb channel positioned on the top surface and extending in a direction across the barrel axis and over the top side of the barrel, the at least one finger channel and the thumb channel being configured to receive at least one finger and the thumb, respectively, of a shooter's forward hand when the shooter holds the firearm.

19. The firearm of claim 18, further comprising:

a fore-end stock between the receiver and the muzzle, wherein the fore-end grip is attached to the fore-end stock.

20. The firearm of claim 18, further comprising:

a fore-end stock between the receiver and the muzzle, wherein the fore-end grip is integrally formed with the fore-end stock.

* * * * *